US011305177B2

(12) United States Patent
Indulti

(10) Patent No.: US 11,305,177 B2
(45) Date of Patent: Apr. 19, 2022

(54) FRONT INSERT FOR A SKI MOUNTAINEERING SKI BOOT, FOR HOOKING THE SKI BOOT TO A SKI MOUNTAINEERING BINDING

(71) Applicant: ATK SPORTS S.r.l., Fiorano Modenese (IT)

(72) Inventor: Davide Indulti, Fiorano Modenese (IT)

(73) Assignee: ATK SPORTS S.R.L., Fiorano Modenese (IT)

( * ) Notice: Subject to any disclaimer, the term of this patent is extended or adjusted under 35 U.S.C. 154(b) by 0 days.

(21) Appl. No.: 17/329,515

(22) Filed: May 25, 2021

(65) Prior Publication Data

US 2021/0370158 A1 Dec. 2, 2021

(30) Foreign Application Priority Data

May 27, 2020 (IT) ..... 102020000012502

(51) Int. Cl.
*A63C 9/10* (2012.01)
*A63C 9/08* (2012.01)
*A63C 9/086* (2012.01)

(52) U.S. Cl.
CPC ..... *A63C 9/10* (2013.01); *A63C 9/0802* (2013.01); *A63C 9/086* (2013.01)

(58) Field of Classification Search
CPC ..... A63C 9/086; A63C 9/02; A63C 9/20
See application file for complete search history.

(56) References Cited

U.S. PATENT DOCUMENTS 5,011,179 A * 4/1991 Bejean ..... A63C 5/0422 280/615
5,125,680 A * 6/1992 Bejean ..... A63C 9/20 280/615
5,224,730 A * 7/1993 Provence ..... A63C 9/20 280/615
5,338,053 A * 8/1994 Hauglin ..... A63C 9/20 280/615
5,735,541 A * 4/1998 Fritschi ..... A63C 9/005 280/617
5,897,127 A * 4/1999 Hauglin ..... A63C 9/06 280/615
5,924,719 A * 7/1999 Girard ..... A63C 9/20 280/615
6,105,994 A * 8/2000 Parris ..... A63C 9/0807 280/614

(Continued)

*Primary Examiner* — Jeffrey J Restifo
(74) *Attorney, Agent, or Firm* — R. Neil Sudol; Henry D. Coleman

(57) ABSTRACT

A front insert for a ski mountaineering boot has first and second heads, positionable on lateral portions of a front part of the boot, a first housing in the first head, a second housing in the second head, and two contact elements with respective holes for coupling with respective hooking elements of a binding. The housings and respective ones of the contact elements are reciprocally conformed so as to enable the contact elements to displace from internal positions with respect to the housings, towards the outside, so that the contact elements orient with respect to the housings so that the holes can misalign from an alignment axis to maintain the contact with the hooking elements following a rotation of the ski boot with respect to the ski.

13 Claims, 8 Drawing Sheets

(56) References Cited

U.S. PATENT DOCUMENTS 6,402,184 B1* 6/2002 Hauglin ..... A63C 9/20 280/615
6,499,761 B1* 12/2002 Quellais ..... A63C 9/20 280/623
6,644,683 B1* 11/2003 Hauglin ..... A43B 5/0411 280/613
11,110,338 B1* 9/2021 Miller ..... A63C 9/06
2003/0047912 A1* 3/2003 Hauglin ..... A63C 9/20 280/615
2004/0041366 A1* 3/2004 Dandurand ..... A63C 7/1053 280/631
2004/0262886 A1* 12/2004 Girard ..... A43B 5/0496 280/615
2006/0087102 A1* 4/2006 Coles ..... A63C 9/08514 280/626
2007/0045987 A1* 3/2007 Shute ..... A63C 7/1026 280/611
2007/0126203 A1* 6/2007 Giffin ..... A63C 9/02 280/615
2010/0257754 A1* 10/2010 Trabucchi ..... A43B 5/0423 36/117.1
2011/0271557 A1* 11/2011 Barthel ..... A63C 9/0807 36/117.1
2011/0298196 A1* 12/2011 Lehner ..... A63C 9/0807 280/611
2012/0018981 A1* 1/2012 Lengel ..... A63C 9/0807 280/623
2013/0087992 A1* 4/2013 Ibach ..... A63C 9/086 280/626
2013/0300089 A1* 11/2013 Barthel ..... A63C 9/08528 280/631
2013/0328289 A1* 12/2013 Vailli ..... A63C 9/003 280/625
2014/0021696 A1* 1/2014 Soldan ..... A63C 9/086 280/625
2014/0110919 A1* 4/2014 Convert ..... A63C 9/08528 280/615
2014/0137439 A1* 5/2014 Pegolo ..... A63C 9/086 36/114
2014/0159345 A1* 6/2014 Indulti ..... A63C 9/086 280/614
2015/0209650 A1* 7/2015 Schroer ..... A43B 5/0421 280/614
2015/0328529 A1* 11/2015 Trabucchi ..... A63C 9/0807 280/11.33
2015/0335987 A1* 11/2015 Nobile ..... A63C 9/0807 280/615
2018/0185737 A1* 7/2018 Zoor ..... A63C 9/0807
2019/0344153 A1* 11/2019 Ibach ..... A63C 9/0807
2020/0129839 A1* 4/2020 Indulti ..... A63C 9/08528
2020/0324187 A1* 10/2020 Stelzer ..... A63C 9/086
2021/0268364 A1* 9/2021 Priest ..... A63C 9/08585
2021/0308552 A1* 10/2021 Lehner ..... A63C 9/08528
2021/0370158 A1* 12/2021 Indulti ..... A43B 5/0423

* cited by examiner

PRIOR ART

FRONT INSERT FOR A SKI MOUNTAINEERING SKI BOOT, FOR HOOKING THE SKI BOOT TO A SKI MOUNTAINEERING BINDING

FIELD OF THE INVENTION

The present invention relates to the technical sector concerning equipment utilised in ski mountaineering.

In particular, the invention relates to a front insert for a ski mountaineering boot, to enable the ski boot to be hooked by a ski mountaineering binding, such as for example a toe-piece of a ski mountaineering binding.

BACKGROUND OF THE INVENTION

A toe-piece of a ski binding for ski mountaineering comprises a base, which is fixed to the ski, and a pair of jaws on which hooking elements are mounted, facing one another, known as pins, which serve to hook the toe-piece to the front part of a ski boot for ski mountaineering.

The jaws are mounted rotatably on the base in such a way as to be activated, due to the presence of elastic means that can be activated by means of a lever, to move the hooking elements (the pins) between a splayed configuration, in which the hooking elements are moved away from one another by a distance such as to enable the insertion there-between of the front part of a ski boot, and a neared hooking configuration in which the hooking elements are neared to one another for the hooking of the ski boot.

The hooking elements of the toe-piece of the binding are movable from the splayed configuration to the neared configuration so that, when positioned in the neared hooking configuration, they are in an operating plane transversal to the ski and perpendicular to the longitudinal axis of the ski.

In ski boots for ski mountaineering, for the hooking thereof to the ski by means of the toe-piece, there are special inserts, made of a metal material, such as for example steel, which are inserted and fixed in the front part of the ski boots during their manufacture.

A front insert (9) for a ski boot for ski mountaineering of known type, for example as illustrated in FIG. 1, comprises an anchoring body (90), for anchoring and fixing to the front part of the ski boot, which has an elongate shape and has two heads (91, 92) at the relative two ends.

The anchoring body (90) is made in such a way as to have an extension such that, once inserted in the ski boot, the two heads (91, 92) are at the opposite lateral walls of the front part of the ski boot.

The known insert (9) also comprises two holes (910) (of which only one is visible in FIG. 1) which are realised at the two heads (91, 92), and are externally accessible.

The two holes (910) are made in such a way that the relative surface has a matching shape to that of the hooking elements that are present in the two jaws of the toe-pieces of the ski mountaineering bindings.

In this way, when the two jaws of the toe-piece of the binding are activated to move the hooking elements into the neared hooking configuration, the hooking elements (the pins) insert by form coupling in the holes, hooking the ski boot to the toe-piece, and thus to the ski.

In substance, the holes have a functional surface on contact with the external surface of the pins, so as to ensure a reciprocal contact to guarantee the hooking.

In this matter, the two holes (910) present in the two heads (91, 92) of the insert (9) mounted in the front part of the ski boot are aligned according to an alignment axis transversal to the ski boot.

When the ski boot is rested on the ski for the hooking, with the front part arranged between the hooking elements of the toe-piece in the splayed configuration, the alignment axis of the holes must be perpendicular to the longitudinal axis of the ski itself.

In this way the alignment axis of the holes is located in the operating plane of the hooking elements when in the neared hooking configuration thereof: this enables the hooking elements to insert in the holes and perform the hooking of the ski boot.

This type of insert, however, presents some drawbacks.

During a descent, with the skis attached, in the event that the skier is subject to transversal stresses on the ski, which generate momentums or torque forces on the ski boot, the boot will tend to rotate, becoming misaligned with respect to the longitudinal axis of the ski.

The front part of the ski boot, therefore, will be subject to a rotation (clockwise or anticlockwise) with respect to the longitudinal axis of the ski according to the direction of the transversal stress or the sense of the momentum of the torque which acts on the ski boot.

The onset of a rotation of the front part of the ski boot with respect to the longitudinal axis of the ski determines a misalignment between the alignment axis of the holes of the insert and the operating plane of the hooking elements in the neared hooking configuration.

Further, owing to the rotation of the front part of the ski boot, and therefore also of the insert, with respect to the longitudinal axis of the ski, a first hole of the insert will tend to near to the longitudinal axis of the ski, retracting with respect to the operating plane of the hooking elements.

The first hole will therefore also distance from the relative hooking element of the toe-piece of the attachment.

This enables the detachment, and decoupling, between the functional surface of the first hole and the external surface of the hooking element, with a consequent unhooking of the ski boot from the toe-piece of the binding for ski mountaineering.

With the inserts of the prior art such as the one described in the foregoing in FIG. 1, even rotations of a small entity cause the unhooking of the ski boot from the toe-piece of the attachment.

This possibility constitutes a drawback, as the skier will have the situation that the hooked ski even in all of those cases in which the stresses received on the ski boot are of an entity such (by duration and/or intensity) as to be able in any case to continue with the ski descent with no issues or consequences.

OBJECTS OF THE INVENTION

An aim of the present invention is therefore to describe a new front insert for a ski mountaineering ski boot, for hooking the ski boot to a ski mountaineering binding, in particular a toe-piece of a ski mountaineering binding, able to obviate the drawbacks discussed in the preceding.

In particular, an aim of the present invention is therefore to describe a new front insert for a ski mountaineering ski boot for ski mountaineering able to maintain the contact with the hooking elements of the toe-piece even consequently to the onset of rotations of the front part of the ski boot with respect to the longitudinal axis of the ski which are not of an entity such as to require, for reasons of safety, the unhooking of the ski boot, thus enabling the skier to proceed in the descent with the skis hooked to the ski boots, and therefore an insert which, while maintaining the contact with the hooking elements during a stress received by the ski boot, can enable a realignment of the ski boot to the ski once the effect of the stress has terminated.

BRIEF DESCRIPTION OF THE DRAWINGS

The characteristics of preferred, but not exclusive, embodiments of the front insert for a ski boot for ski mountaineering of the present invention will be described in the following with reference to the appended tables of drawings, in which.

DETAILED DESCRIPTION

Figure 1:
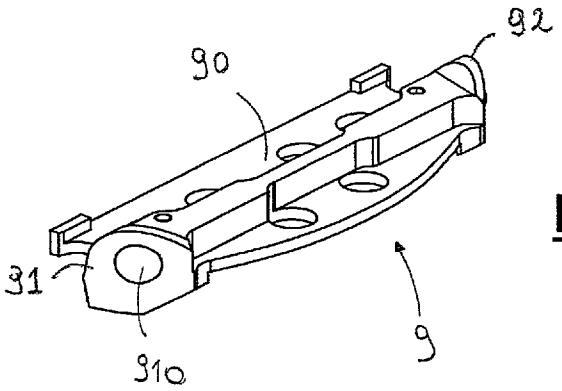
FIG. 1, already mentioned in the foregoing, is a schematic perspective view of a front insert for a ski boot for ski mountaineering of the prior art.

With reference to the appended tables of drawings, reference numeral (100) denotes the front insert for a ski boot (S) for ski mountaineering, object of the present invention, in its entirety, in various embodiments, in its entirety.

The front insert (100) of the invention is designed to be coupled to a front part of a ski boot (S) for ski mountaineering, for enabling the hooking of the ski boot (S) to a binding (A) for ski mountaineering, fixed to a ski (K) for ski mountaineering.

Figure 5C:
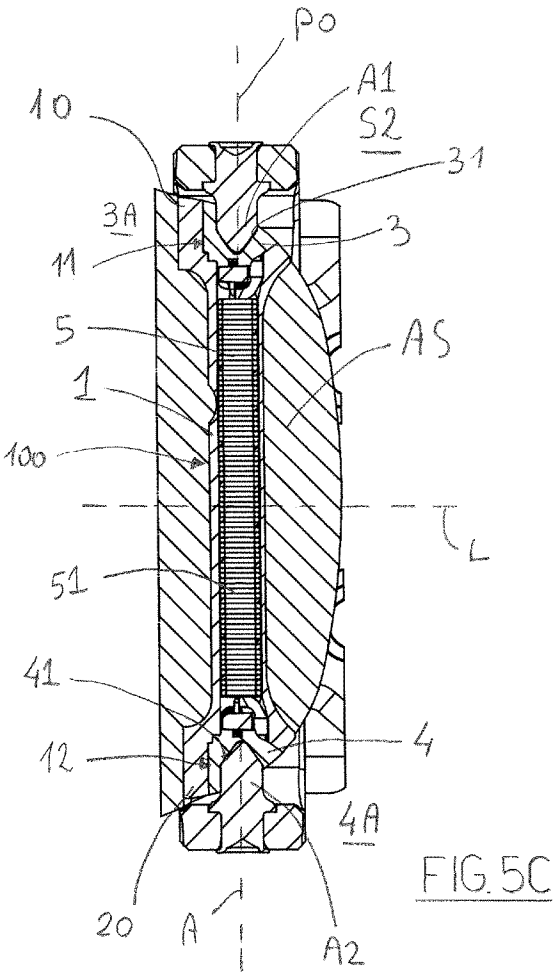
FIG. 5C is a larger-scale view of the detail denoted by letter K1 of FIG. 5B.
Figure 5A:
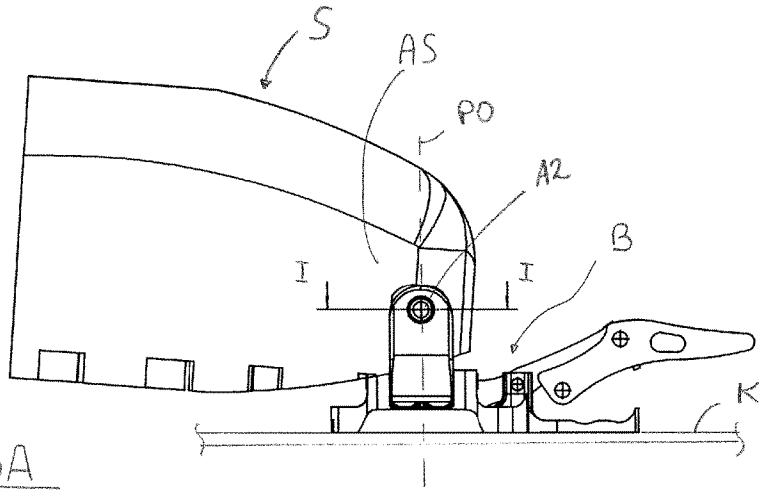
FIG. 5A illustrates, in a lateral view, the front part of a ski boot for ski mountaineering provided with the insert of the invention, according to the first preferred embodiment, and a toe-piece of a ski binding for ski mountaineering in the hooked configuration to the ski boot.
Figure 5B:
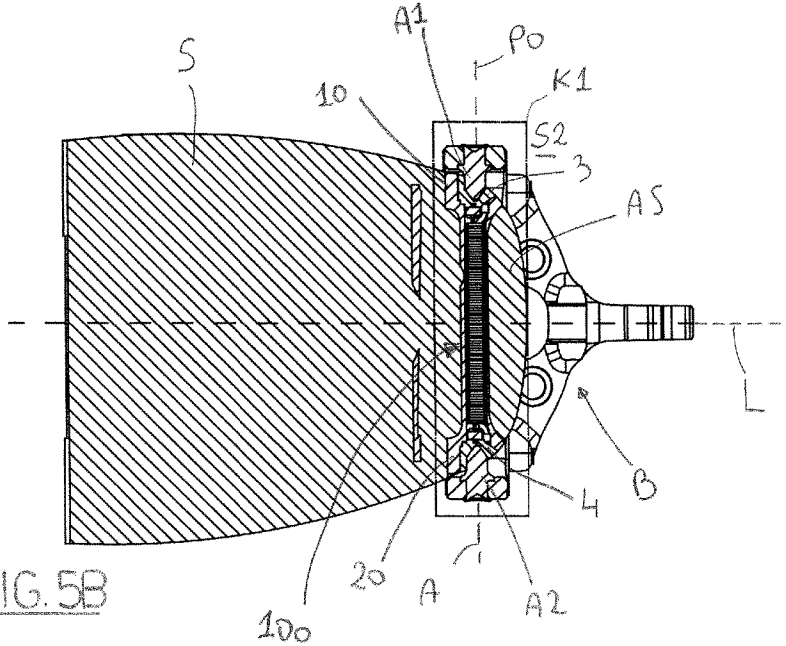
FIG. 5B is the view according to section plane I-I of FIG. 5A, in which the hooking elements of the toe-piece of the ski mountaineering binding are visible in the neared hooking configuration thereof with the insert, and therefore with the ski boot; this figure illustrates the hooked configuration for the descent wearing the skis.
Figure 6C:
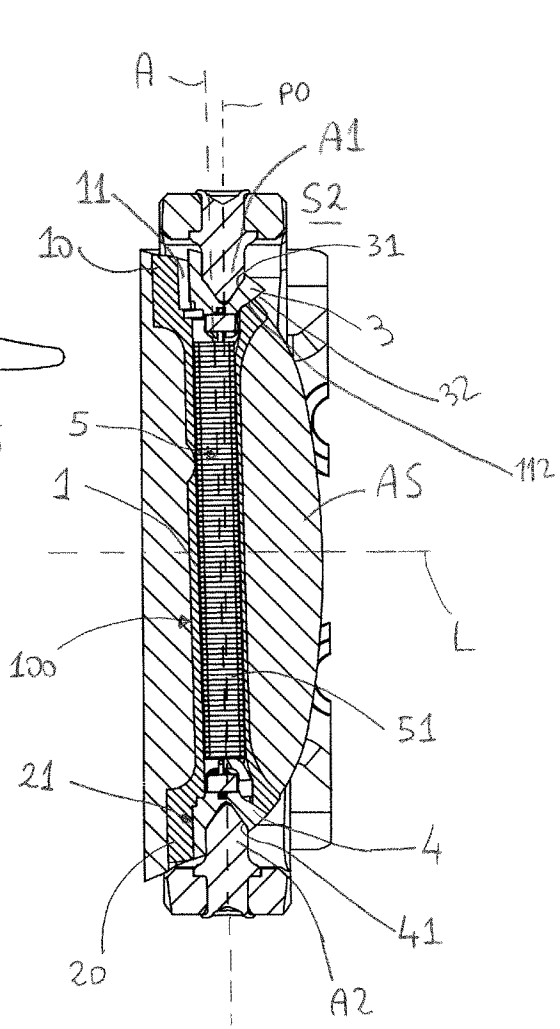
FIG. 6C illustrates the detail denoted by K2 in FIG. 66, in larger scale.
Figure 6A:
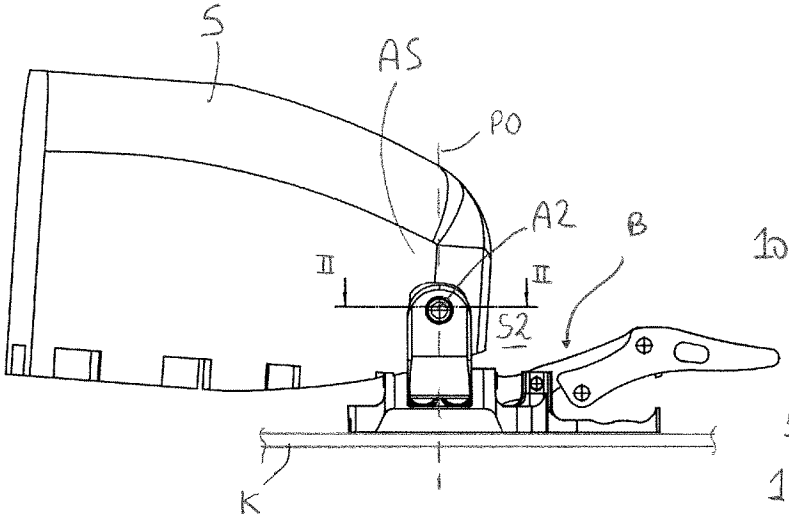
FIG. 6A illustrates, in a lateral view, the front part of a ski boot for ski mountaineering provided with the insert of the invention, according to the first embodiment and a toe-piece of a ski binding for ski mountaineering in the hooked configuration to the ski boot, with the ski boot being subjected to a stress which leads it to rotate with respect to the longitudinal axis of the ski.
Figure 6B:
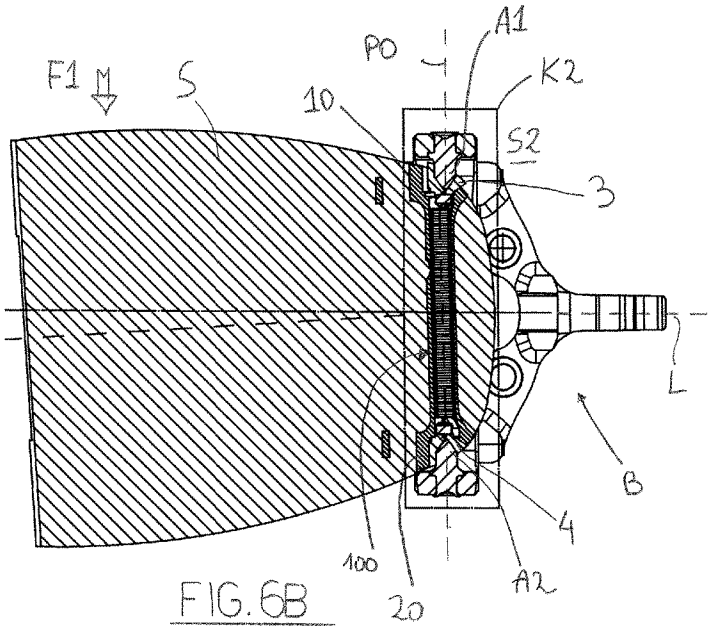
FIG. 6B illustrates the view according to section plane III-III of FIG. 6A, in which the hooking elements of the toe-piece of the ski mountaineering binding are visible in the neared hooking configuration thereof, and with the ski boot which, owing to a stress (F1) received, is rotating with respect to the longitudinal axis (L) of the ski and with the insert of the invention which is adapting to the rotation that the ski boot is undertaking, in order to maintain the contact with the hooking elements.
Figure 7C:
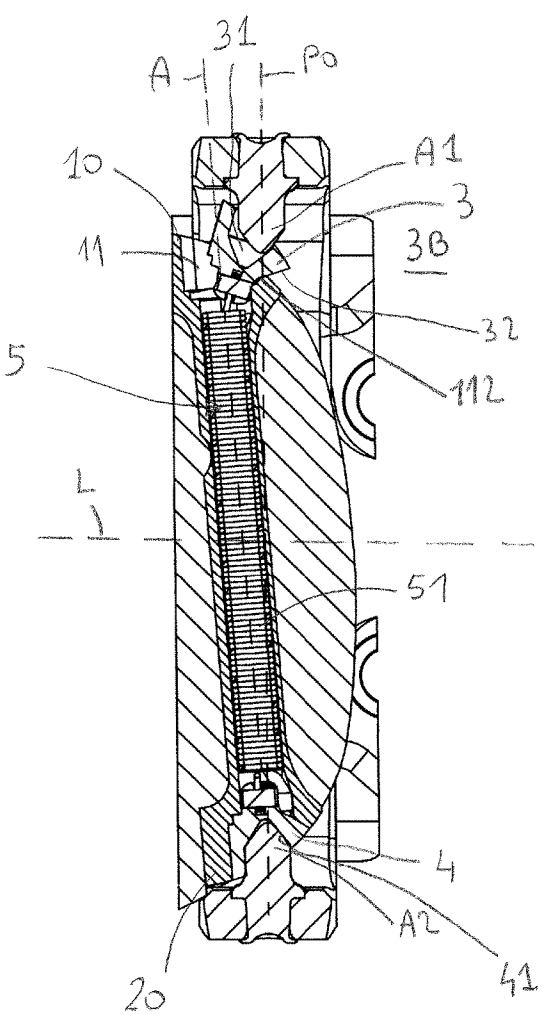
FIG. 7C illustrates the detail denoted by K3 in FIG. 7B, in larger scale.
Figure 7A:
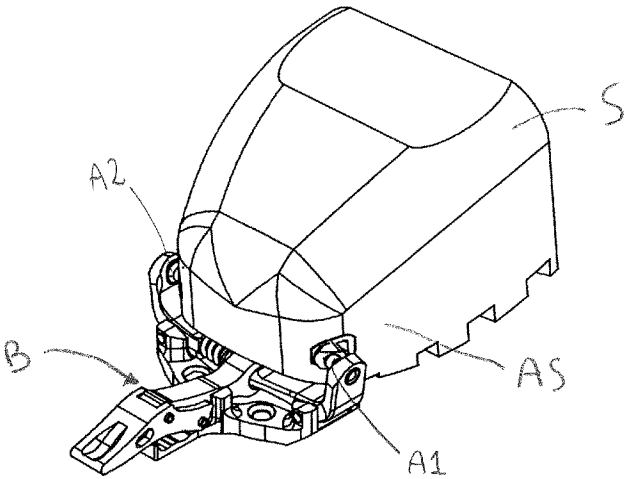
FIG. 7A is a schematic perspective view of the front part of the ski boot for ski mountaineering with the hooking elements of the toe-piece in the neared configuration thereof and with the insert of the invention, in the first embodiment, illustrated in the second configuration in which it has adapted to the rotation undertaken by the ski boot while maintaining the contact with the hooking elements.
Figure 7B:
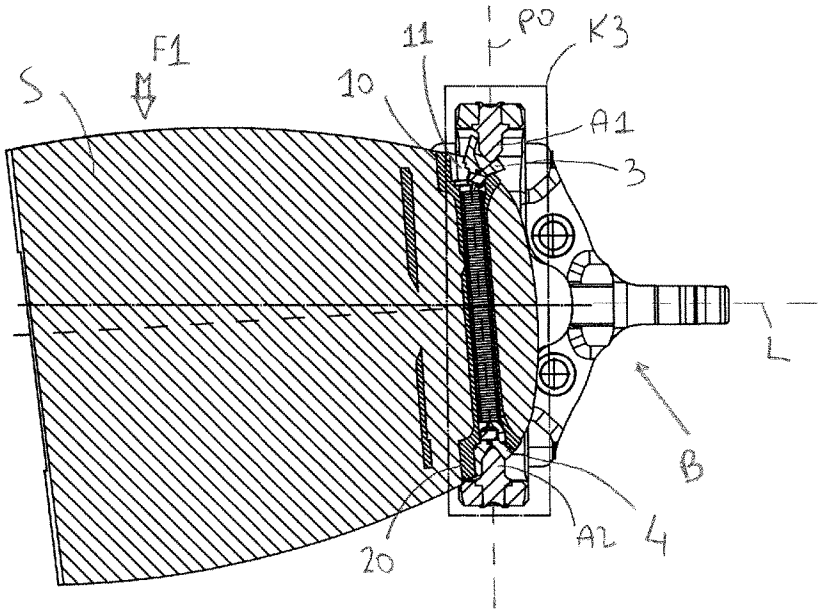
FIG. 7B is a view according to a transversal section plane taken at the hooking elements of FIG. 7A.

A binding (B) for ski mountaineering comprises a first hooking element (A1) and a second hooking element (A2), facing one another, and which are movable between a splayed configuration (not illustrated in detail in the figures), in which the first hooking element (A1) and the second hooking element (A2), are in a splayed position with respect to one another to enable inserting there-between a front part (AS) of a ski boot, for ski mountaineering, and a neared configuration (S2) wherein the first hooking element (A1) and a second hooking element (A2) are in a neared position with respect to one another, in an operating plane (PO) that is transversal and perpendicular to a longitudinal axis (L) of the ski (K), for hooking the ski boot (S) (this neared hooking configuration (S2) is for example illustrated in the FIGS. 5B, 6B and 7B).

The front insert (100) of the invention is conformed so as to comprise an anchoring body (1) comprising two heads (10, 20) and having dimensions such that the two heads (10, 20), when the insert (100) is fixed to the ski boot (S), are positioned at lateral portions of the front part (AS) of the ski boot (S).

The peculiarities of the insert (100) of the invention consist in the fact that it comprises (see for example FIG. 2A and FIG. 3A):

a first housing (11), which is made in the first head (10), as is a second housing (21), in turn made in the second head (20);

a first contact element (3) comprising a first hole (31) which is conformed so as to have a coupling surface (310) for coupling with the first hooking element (A1), and a second contact element (4) comprising a second hole (41) which is conformed so as to have a coupling surface (410) for coupling with the second hooking element (A2).

In detail, the first housing (11) and the first contact element (3) are reciprocally conformed so that the first contact element (3) is positionable with respect to the first housing (11) so that the first hole (31) is accessible from outside, and aligned with an alignment axis (A), and is positionable in the first housing (11) in an internal position (3A) with the first hole (31) aligned with the alignment axis (A); and the second housing (21) and the second contact element (4) are reciprocally conformed so that the second contact element (4) is positionable with respect to the second housing (21) so that the second hole (41) is accessible from outside, and aligned with the alignment axis (A), and is positionable in the second housing (21) in an internal position (4A) with the second hole (41) aligned with the alignment axis (A) (see for example FIG. 3A 4B, 8A, 9A, 10A, 11A).

Figure 2B:
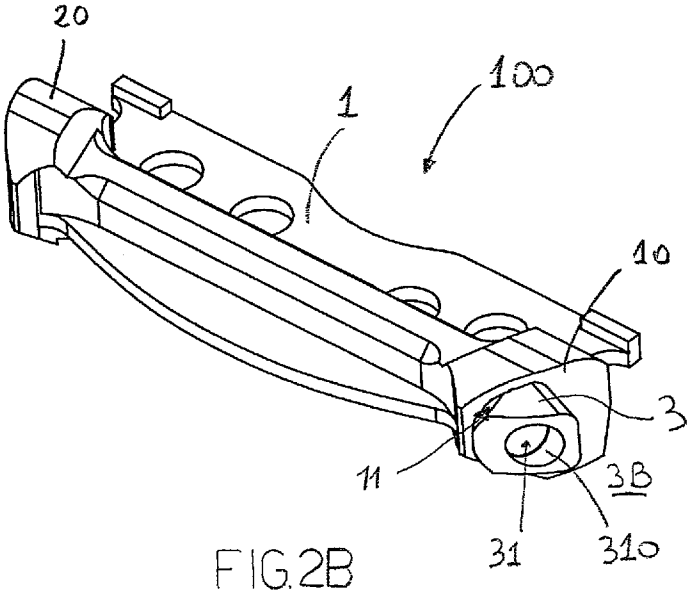
FIG. 2B illustrates, again in a perspective view, the insert of the invention in a second possible configuration in which the insert adapts to an eventual rotation impressed on the ski boot in such a way as in any case to maintain the contact with the hooking elements of a toe-piece of an attachment for ski mountaineering, which is not illustrated as of known type.
Figure 3A:
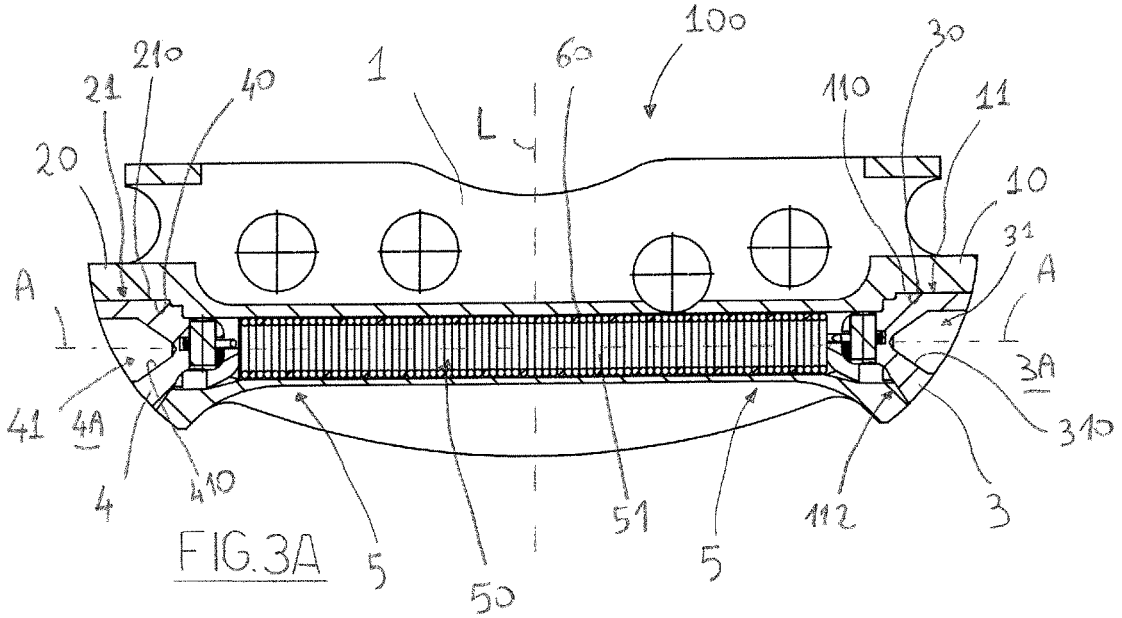
FIG. 3A is a view according to a longitudinal transversal section plane view of the insert of FIG. 2A, in a first preferred embodiment.
Figure 3B:
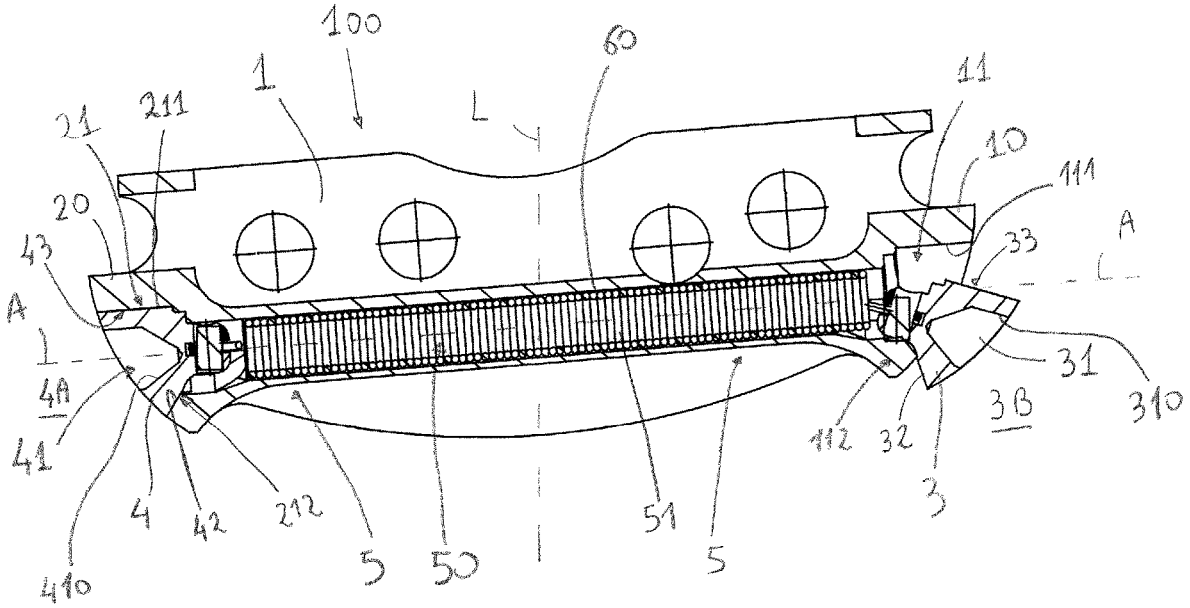
FIG. 3B is a view according to a longitudinal transversal section plane view of the insert of FIG. 2B, in the first embodiment.

Further in a special aspect of the insert (100) of the invention, the first housing (11) and the first contact element (3) are further reciprocally conformed so as to enable the first contact element (3) to displace with respect to the first housing (11) from the internal position (3A) towards the outside so that the first contact element (3) can orientate and position with respect to the first housing (11) so that the first hole (31) misaligns from the alignment axis (A) (see for example FIG. 2B and FIG. 3B); and the second housing (21) and the second contact element (4) are reciprocally conformed so as to enable the second contact element (4) to displace with respect to the second housing (21) from the internal position (4A) towards the outside so that the second contact element (4) can orientate and position with respect to the second housing (21) in such a way that the second hole (41) misaligns from the alignment axis (A) (this situation is not illustrated in detail in the figures as it is exactly a mirror image of the situation illustrated for the first contact element (3) in FIGS. 2B and 3B).

Figure 2A:
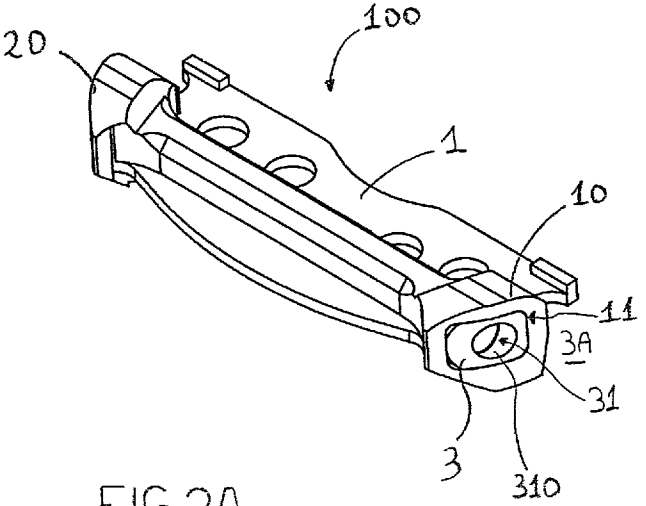
FIG. 2A illustrates, in a schematic perspective view, the front insert for a ski boot for ski mountaineering of the present invention, in a first configuration in which the insert is ready to receive in a coupling the hooking elements of a toe-piece of a binding for ski mountaineering, not illustrated as of known type.

The front insert (100) of the invention is configured in such a way that, before the ski boot (S) is rested on the ski, the first contact element (3) and the second contact element (4) are arranged with respect to the first housing (11) and the second housing (12) so that the first hole (31) in the first contact element (3) and the second hole (41) in the second contact element (4) are aligned along the alignment axis (A) (see the configuration illustrated in FIG. 2A and FIG. 3A).

Figure 4C:
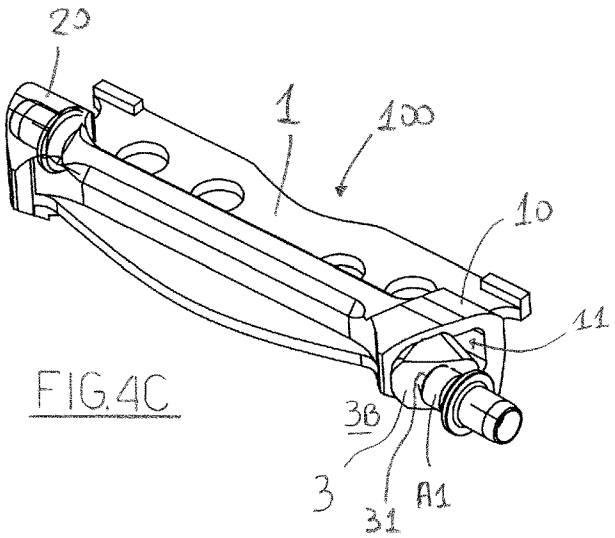
FIG. 4C illustrates, according to a schematic perspective view, the insert of the present invention in the second configuration of FIG. 2B, with the hooking elements of a toe-piece of an attachment for ski mountaineering, represented in the neared configuration thereof for the hooking with the insert and thus with the ski boot (not illustrated), and in which the insert of the invention has adapted to a rotation of the ski boot with respect to the longitudinal axis of the ski in such a way as to be able to maintain, in any case, the contact with the hooking elements.
Figure 4D:
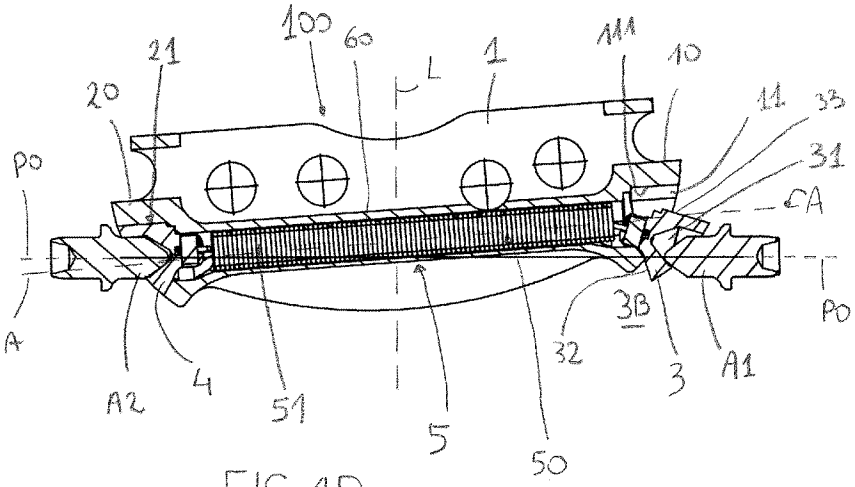
FIG. 4D is a view according to a longitudinal transversal section plane view of the insert of FIG. 4C, in the first embodiment, in which the longitudinal axis (L) of a ski (not illustrated) is illustrated to which the ski boot for ski mountaineering (not illustrated) is to be hooked, with the insert of the invention which has adapted to a rotation of the ski boot with respect to the longitudinal axis of the ski in such a way as to be able to maintain, in any case, the contact with the hooking elements in the neared configuration thereof.
Figure 4A:
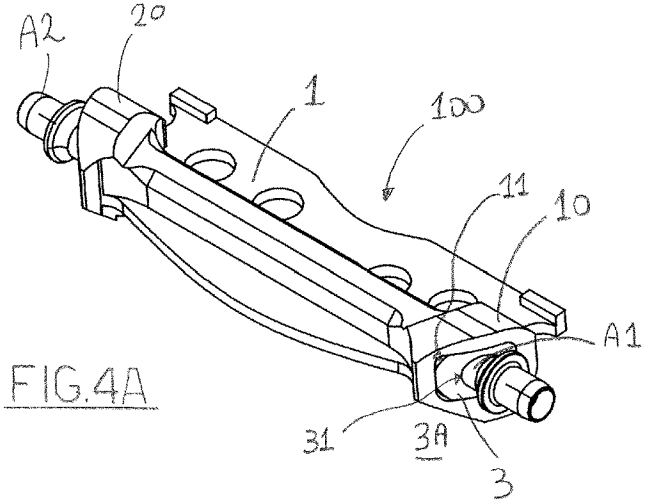
FIG. 4A illustrates, according to a schematic perspective view, the insert of the present invention in the first configuration of FIG. 2A, with the hooking elements of a toe-piece of an attachment for ski mountaineering, represented in the neared configuration thereof for the hooking with the insert and thus with the ski boot (not illustrated)
Figure 4B:
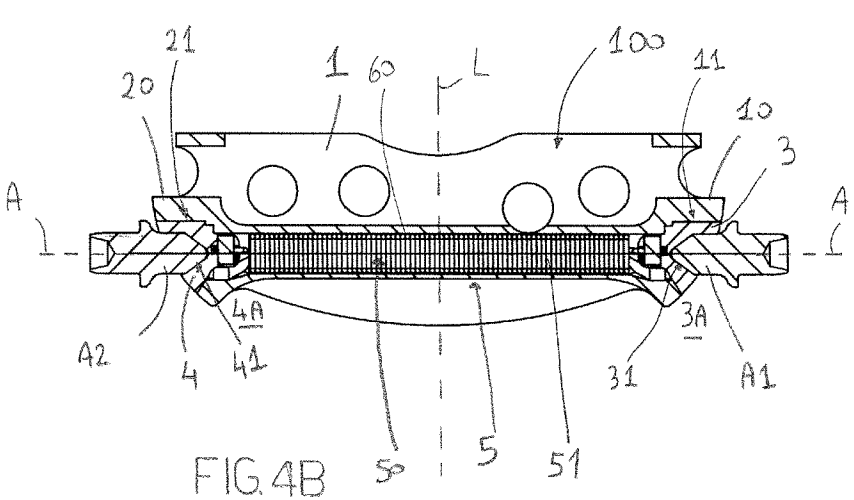
FIG. 4B is a view according to a longitudinal transversal section plane view of the insert of FIG. 4A, in the first embodiment, which illustrates the longitudinal axis (L) of a ski (not illustrated) to which the ski boot for ski mountaineering (not illustrated) is hooked.

In this way, owing to the particular characteristics described in the foregoing:

when the ski boot (S) is rested on the ski (K) and positioned with the front part (AS) between the first hooking element (A1) and the second hooking element (A2) in the splayed configuration, the alignment axis (A) of the first hole (31) and of the second hole (41) is aligned to the operating plane (PO) of the hooking elements (A1, A2) so that the first hooking element (A1) and the second hooking element (A2) can be moved into the neared configuration (S2) for hooking the ski boot (S), with the first hooking element (A1) inserting in the first hole (31) of the first contact element (3) and with the first contact element (3) in the relative internal position (3A) of the first housing (11) and with the second hooking element (A2) inserting in the second hole (41) of the second contact element (4) and with the second contact element (4) in the relative internal position (4A) of the second housing (21) (see for example FIG. 4A and FIG. 4B, and also FIGS. 5A, 5B and 5C, and also FIGS. 8A, 9A, 10A and 11A);

and so that, following the hooking of the ski boot (S), at least one from between the first contact element (3) and the second contact element (4), consequently to a rotation of the ski boot (S) with respect to the longitudinal axis (L) of the ski (K) which determines a misalignment between the alignment axis (A) and the operating plane (PO) of the hooking elements (A1, A2), can be pushed by the relative hooking element (A1, A2) to perform a displacement from the internal position (3A, 4A) towards the outside of the first (11) or second housing (21) orientating and positioning itself with respect to the relative first (11) or second housing (21) in such a way that the relative first hole (31) or second hole (41) misaligns from the alignment axis (A), so as to remain in contact with the hooking element (A1, A2), thus guaranteeing the maintaining of the hooking of the ski boot (S) (see the sequence of FIGS. 5B, 6B and 7B, as well as the larger-scale details in the sequence of FIGS. 5C, 6C and 7C, or FIGS. 4C and 4D, or FIGS. 8B, 9B, 10B and 11B).

Therefore, in a case where the ski boot (S), once hooked to the binding (B) for ski mountaineering, by means of the coupling of the hooking elements (A1, A2) in the holes (31, 41) of the contact elements (3, 4) (this situation is illustrated in FIGS. 5A, 5B and 5C), during the descent, is subject to a stress (F1) (for example a transversal force to the longitudinal axis (L) of the ski) which leads it to perform a rotation with respect to the longitudinal axis of the ski (this situation is illustrated, for example, in FIGS. 6B and 6C, and visible in FIGS. 7B and 7C), the insert of the invention enables maintaining the contact in any case and thus remain hooked to the binding (B), due to the fact that at least one of the two contact elements (3, 4) can perform, with respect to the relative housing (11, 21), a displacement from the relative internal position (3A, 4A) towards the outside, by orientating and positioning itself so that the relative hole (31, 41) is no longer aligned to the alignment axis (A) with the other hole (A), as happens for the inserts of known type.

This enables the coupling surface (310, 410) of the hole (31, 41) to maintain in any case a contact with the relative hooking element (A1, A2), even when the ski boot (S) is rotating with respect to the longitudinal axis (L) of the ski (K), and thus enable the ski boot to stay hooked to the ski and also enable the skier to continue the descent without suffering a sharp, unexpected and undesired unhooking from the ski.

In a preferred aspect, the coupling surface (130, 140) of the first (31) and second hole (41) is realised in such a way as to have a matching shape to that of the first (A1) and second (A2) hooking element.

They can for example be conformed so as to have a cylindrical or truncoconical shape, complementarily profiled with respect to the truncoconical shape that the hooking elements (A1, A2) of the binding's (toe-pieces) for ski mountaineering can have.

Alternatively the coupling surfaces (130, 140) of the first (31) and second (41) hole can be conformed so as to have a cylindrical shape, complementarily profiled with respect to the cylindrical shape that the hooking elements (A1, A2) of the bindings (toe-pieces) for ski mountaineering can have.

Other further advantageous characteristics of the insert of the invention are described in the following, with reference to the various possible embodiments.

In an especially preferred aspect, the walls (110) of the first housing (11) and the walls (30) of the first contact element (3) are reciprocally conformed in such a way as to form a form coupling of the first contact element (3) with the first housing (11) when the first contact element (3) is in the internal position (3A), and the walls (210) of the second housing (21) and the walls (40) of the second contact element (4) are conformed in such a way as to enable a form coupling of the second contact element (4) with the second housing (21) when the second contact element (4) is in the internal position (4A).

In particular, as illustrated for example in FIG. 3A, and in FIG. 4B, the walls (110, 210) of the first (11) and second (21) housing are conformed so that when the first (3) and second (4) contact element are internal thereof in the relative internal positions (3A, 4A), the two contact elements (3, 4) are reciprocally positioned and orientated so that the first (31) and second (41) hole are aligned to one another along the alignment axis (A), i.e. aligned to one another along a same axis.

In greater detail, the alignment axis (A) is such as to be in the operating plane (PO) of the hooking elements (A1, A2) in the neared configuration (S2) of hooking thereof, in order to enable the hooking elements (A1, A2) to insert and couple with the coupling surfaces (130, 140) of the first (31) and second (41) hole for hooking the ski boot (S) (see for example FIGS. 4A 4B, 8A, 9A, 10A, 11A).

Further, the walls (110) of the first housing (11) and the walls (30) of the first contact element (3) are reciprocally conformed in such a way as to enable a displacement of the first contact element (3), from the internal position (3A) to the first housing (11), outwardly, which comprises a first translation movement and a second rotation movement so that the first contact element (3) can orientate and position with respect to the first housing (11) with the first hole (31) misaligning from the alignment axis (A) (see for example FIG. 3B).

In the same way, the walls (210) of the second housing (21) and the walls (40) of the second contact element (4) are further reciprocally conformed in such a way as to enable a displacement of the second contact element (4), from the internal position (4A) to the second housing (21), towards the outside, which comprises a first translation movement and a second rotation movement so that the second contact element (4) can orientate and position with respect to the second housing (21) with the second hole (41) misaligning from the alignment axis (A) (this situation has not been illustrated in the figures, as it is a mirror image of the situation of the first contact element of FIG. 3B).

In a preferred aspect, the walls (110) of the first housing (11) comprise a rear rest wall (111) and a front rest wall (112) inclined with respect to the alignment axis (A) and which is inclined with respect to the longitudinal axis (L) of the ski (K) when the ski boot (S) is rested on the ski (K) and hooked to the binding (B) for ski mountaineering.

For example, the rear rest wall (111) can be arranged parallel to the alignment axis (A) (as shown in the figures) or also in another orientation.

The walls (30) of the first contact element (3), on their part, comprise a rear abutting wall (33) and a front abutting wall (32), with the rear abutting wall (33) being conformed in such a way as to abut the rear rest wall (111) of the first housing (11) and with the front abutting wall (32) being conformed in such a way as to abut the front rest wall (112) of the first housing (11) when the first contact element (3) is in the internal position (3A) of the first housing (11).

In this way, the front rest wall of the second housing (112) constitutes a plane that is inclined with respect to the alignment axis (A), as well as with respect to the longitudinal axis of the ski, when the ski boot is hooked to the attachment (B), which defines the translation direction for the first translation movement of the first contact element (3) when it undergoes the displacement from the internal position (3A) towards the outside (see for example FIGS. 6B and 6C).

When the front abutting wall (32) of the first contact element (3), during the first translation movement, decouples from the front rest wall (112), then the first contact element (3) can start the second movement in rotation of the displacement thereof in an outward direction.

Likewise, the walls (210) of the second housing (21) comprise a rear rest wall (211) and a front rest wall (212) inclined with respect to the alignment axis (A) and which is inclined with respect to the longitudinal axis (L) of the ski when the ski boot (S) is rested on the ski (K) and hooked to the binding (B) for ski mountaineering.

For example, the rear rest wall (211) can be arranged parallel to the alignment axis (A) (as shown in the figures) or also in another orientation.

The walls (40) of the second contact element (4), on their part, comprise a rear abutting wall (43) and a front abutting wall (42), with the rear abutting wall (43) being conformed in such a way as to abut the rear rest wall (211) of the second housing (21) and with the front abutting wall (42) being conformed in such a way as to abut the front rest wall (412) of the second housing (21) when the second contact element (4) is in the internal position (4A) of the second housing (21).

In this way, as in the case of the first contact element (3), the front rest wall (212) of the second housing (21) constitutes a plane that is inclined with respect to the alignment axis (A), as well as with respect to the longitudinal axis of the ski, when the ski boot is hooked to the attachment (B), which defines the translation direction for the first translation movement of the second contact element (4) when it undergoes the displacement from the internal position (4A) towards the outside.

When the front abutting wall (42) of the second contact element (4), during the first movement in translation, decouples from the front rest wall (212), the second contact element (4) can initiate the second rotation movement of the displacement thereof in an outward direction.

According to preferred embodiments, for example those illustrated in FIGS. 3A, 3B, 4B, 4D, 5B, 8A, 8B, 9A, 9B, 11A, 11B, the insert (100) is realised in such a way as to comprise positioning means (5) which are configured in such a way as to maintain the first contact element (3) positioned in the internal position (3A) of the first housing (11) and the second contact element (4) positioned in the internal position (4A) of the second housing (21), the first hole (31) and the second hole (41) being aligned with the alignment axis (A).

This enables the hooking elements (A1, A2), when they are moved into the neared configuration (S2) thereof for hooking the ski boot, to be able to insert into and couple with the two holes (31, 41).

The positioning means (5) are further configured so as to enable the displacement of the first contact element (3) from the internal position (3A) towards the outside and the displacement of the second contact element (4) from the internal position (4A) towards the outside so that the first contact element (3) can orientate and position with respect to the first housing (11) with the first hole (31) misaligned from the alignment axis (A) and so that the second contact element (4) can orientate and position with respect to the second housing (21) with the second hole (41) misaligned from the alignment axis (A).

In particular, the positioning means (5) comprise elastic means (50) which are predisposed in a seat (60) realised in the anchoring body (1) in such a way as to be constrained to the first contact element (3) and the second contact element (4).

In the embodiment illustrated in FIGS. 3A, 3B, 4B, 4D, 5B, 6B and 7B, the elastic means (50) are constituted by a traction spring (51) positioned in a seat (60) realised in the anchoring body (1) and communicating with the first housing (11) and the second housing (21).

The traction spring (51) is constrained by a first end to the first contact element (3) and by a second end to the second contact element (4).

Figure 11A:
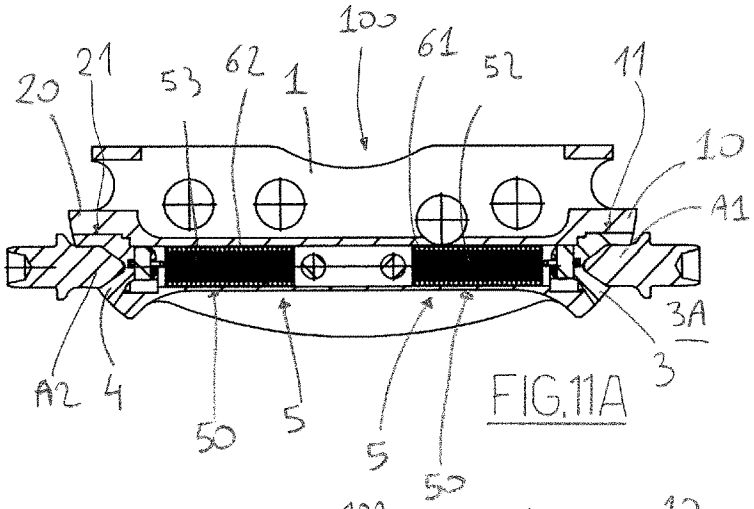
FIGS. 11A and 11B are views of the insert of the invention in a fifth possible embodiment according to a longitudinal and transversal section plane, in the two distinct configurations.
Figure 11B:
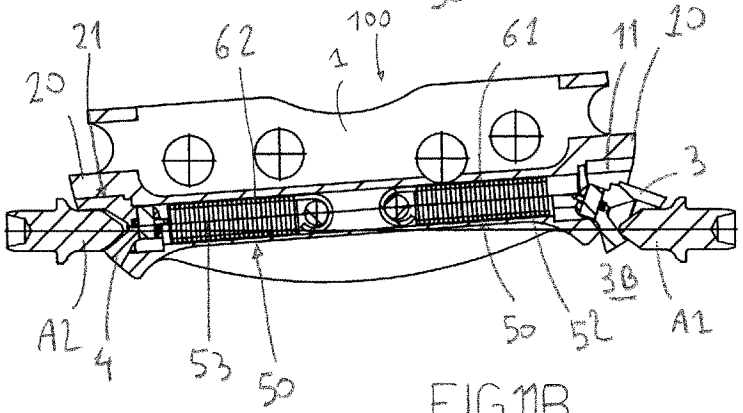

Possibly, in another possible embodiment, such as for example the one illustrated in FIGS. 11A, 11B, the elastic means (50) are constituted by two traction springs (52, 53) positioned in relative seats (61, 62) realised in the anchoring body (1) and communicating with the first housing (11) and the second housing (21).

A first traction spring (52) is fixed by a first end thereof to the anchoring body (1) and by a second end to the first contact element (3), while the second traction spring (53) is fixed by a first end thereof to the anchoring body (1) and by a second end to the second contact element (4).

In both embodiments, the traction springs (51, 52, 53) are configured so as to retain and maintain the first contact element (3) in the internal position (3A) of the first housing (11) and the second contact element (4) in the internal position (4A) of the second housing (21) and to enable the displacement from the relative internal position (3A, 4A) towards the outside.

In particular, the traction springs (51, 52, 53) are further configured so as to retain and maintain the first contact element (3) and the second contact element (4) in the internal position (3A, 4A), following the detachment and decoupling of the first contact element (3) and the second contact element (4) from the first hooking element (A1) and the second hooking element (A2) consequently to the unhooking of the binding (B) for ski mountaineering from the ski boot.

The unhooking of the ski boot from the ski mountaineering binding can indeed occur when the rotation of the ski boot, with respect to the longitudinal axis of the ski, exceeds a maximum limit value, beyond which the unhooking takes place, as the stresses received are such as to have to ensure, for reasons of safety, the unhooking of the ski boot.

In this regard, the traction springs (51, 52, 53) are configured so as to enable a displacement of the first contact element (3) from the internal position (3A) of the first housing (11) towards the outside up to a final external position (3B) (see for example FIG. 4D, FIG. 7B, FIG. 7C, or FIG. 11B), wherein the first contact element (3) is orientated and positioned so that the first hole (31) has an angle of inclination that is maximum with respect to the alignment axis (A) beyond which the detaching and decoupling of the first contact element (3) with the first hooking element (A1) takes place and therefore the unhooking of the ski boot (S).

In FIG. 7C it can be noted how the front abutting wall (32) of the first contact element (3) has decoupled from the front rest wall (112), enabling a rotation of the first contact element (3) with respect to the first housing (11), up to arriving in a final external position (3B).

FIG. 7C illustrates, based on the inclination of the front rest wall (112), the final external position (3B) in which it can reach the first contact element (3) to maintain the contact with the first hooking element (A1) following a rotation of the ski boot (S) with respect to the longitudinal axis of the ski, and thus the maximum angle of misalignment between the alignment axis (A) (the initial position of the two holes for the hooking with the hooking elements) and the operating plane (PO) of the hooking elements (A1, A2) in the neared configuration (S2) of hooking of the ski boot (and thus also the maximum angle of inclination of the alignment axis (A) with the longitudinal axis of the ski).

The final external position (3B) of the first contact element (3), with respect to the first housing (11), can be varied on the basis of the effective inclination with which the front rest wall (112) of the first housing (11) is realised.

The configuration of this figure thus represents the maximum rotation which the ski boot can reach with respect to the longitudinal axis of the ski, during the descent with the skis, following a stress that has been received, so that the skier can continue skiing as the insert guarantees the contact in any case, and thus the hooking with the contact elements.

Beyond this rotation angle the ski boot will be unhooked.

Since, as illustrated in FIG. 7C), the first contact element (3) has maintained, during the rotation of the ski boot, contact with the first hooking element (A1) of the attachment (B) up to reaching the final external position (3B), at the end of the stress action on the ski boot that has caused the rotation, the insert (100) will enable the ski boot (S) to realign automatically to the ski, as the first contact element (3) will return towards the relative internal position (3A) of the first housing (11).

With the insert of the invention, this maximum angle of rotation will be significantly higher than the rotation angles at which, with the inserts of the prior art such as the one illustrated in FIG. 1, the ski boot is unhooked.

In an entirely like way, in the two embodiments described in the foregoing, the traction springs (51, 52, 53) are configured so as to enable a displacement of the second contact element (4) from the internal position (4A) of the second housing (21) towards the outside up to a final external position wherein the second contact element (4) is orientated and positioned so that the second hole (41) has an angle of inclination that is maximum with respect to the alignment axis (A) beyond which the detaching and decoupling of the second contact element (4) with the second hooking element (A2) takes place and therefore the unhooking of the ski boot (S).

In the figures, the final external position of the second contact element (4) has not been illustrated, as it is a mirror image of the position of the first contact element (3).

The first contact element (3) and the second contact element (4) can preferably and advantageously be constrained removably to the traction springs, i.e. they can be decoupled from the springs to be replaced, in the case of wear or damage, by other contact elements, or by contact elements with holes having a suitable shape for a possible change of profile of the hooking elements of the ski bindings.

Figure 9A:
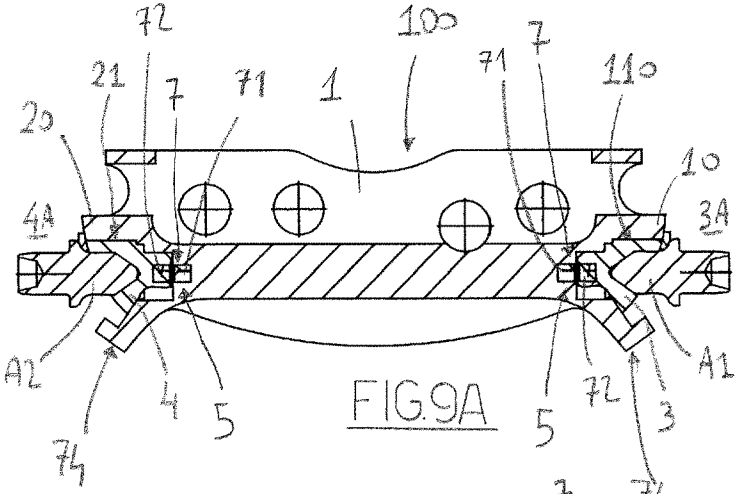
FIGS. 9A and 9B are views of the insert of the invention in a third possible embodiment according to a longitudinal and transversal section plane, in the two distinct configurations.
Figure 9B:
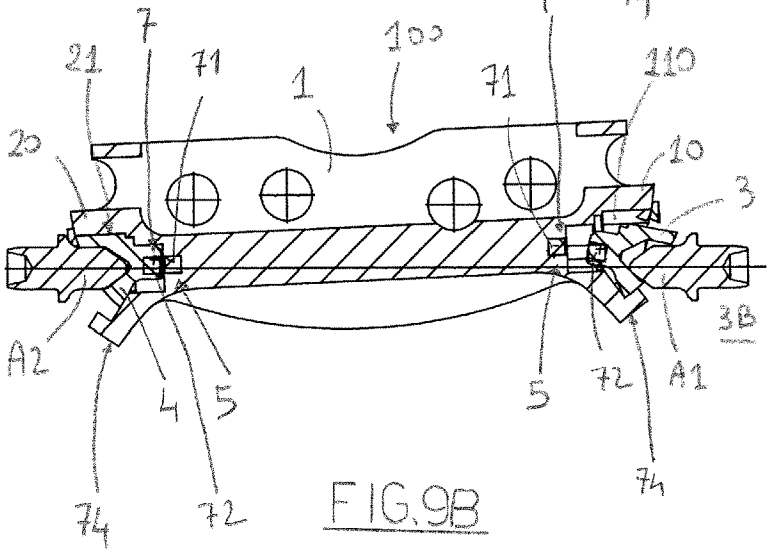

In a further possible preferred embodiment, illustrated in FIGS. 2A, 9A and 9B, the positioning means (5) can be constituted by magnetic means (7).

In particular, the magnetic means (7) can comprise first magnetic means (71) having a first polarity which are predisposed in the first contact element (3) and in the second contact element (4) and second magnetic means (72) having a second polarity opposite to the first polarity which are predisposed in a bottom wall of the first housing (11) and second housing (21).

Figure 8A:
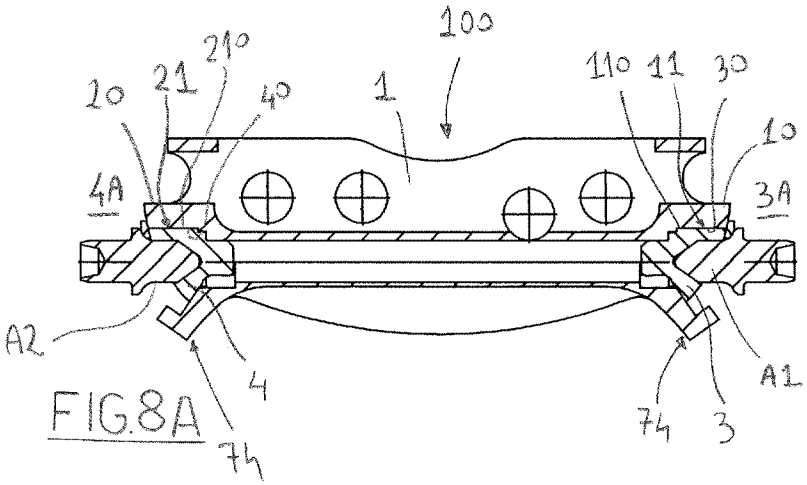
FIGS. 8A and 8B are views of the insert of the invention in a second possible embodiment according to a longitudinal and transversal section plane, in the two distinct configurations.
Figure 8B:
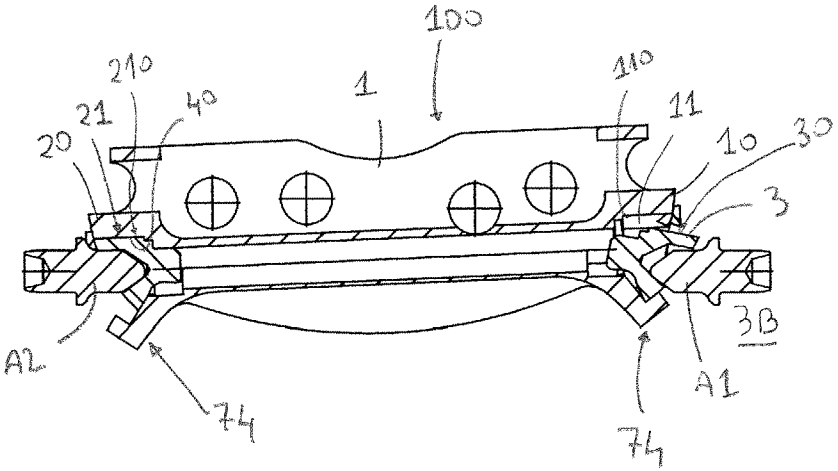

In a further possible embodiment, illustrated in FIGS. 8A, 8B, the positioning means (5) can instead be directly constituted by the walls (110) of the first housing (11) and the walls (30) of the first contact element (3) which are reciprocally conformed to form a form coupling so as to maintain stationary and retain the first contact element (3) in the first housing (11) when the first contact element (3) is in the internal position (3A), and also by the walls (210) of the second housing (21) and the walls (40) of the second contact element (4) which are reciprocally conformed to form a form coupling which maintains stationary and retains the second contact element (4) in the second housing (21) when the second contact element (4) is in the internal position (4A).

In the two latter embodiments, in reference to FIGS. 8A, 8B, 9A, 9B, the insert (100) can be made in such a way as to comprise retaining elements (74) which are predisposed at the heads (10, 20) of the anchoring body (1) and which are conformed and configured to retain the first contact element (3) and the second contact element (4), once displaced externally of the first housing (11) and second housing (21), following the detaching and decoupling from the hooking elements (A, A2) of the ski mountaineering binding following the unhooking from the ski boot (S).

In substance, as illustrated in FIGS. 8B and 9B, the retaining elements (74) are conformed as a sort of end run having a shape such as to retain the first contact element or the second contact element, and prevent them from falling, once it has lost contact with the relative hooking element, and thus the ski boot has unhooked from the binding (B).

In a further other possible embodiment, the insert (100) can be made in such a way as to comprise elastic positioning means (500) comprising at least one compression spring (56, 57).

The at least one compression spring (56, 57) can for example be predisposed in at least a seat (64, 65) realised in the anchoring body (1) and communicating with the first housing (11) and the second housing (21), so as to be constrainable to the first contact element (3) and the second contact element (4).

The at least a compression spring (56, 57) is configured so as to maintain, before the hooking of the ski boot, the first contact element (3) and the second contact element (4) positioned with respect to the first housing (11) and the second housing (21) so that the first hole (31) and the second hole (41) are aligned with the alignment axis (A) and thus enable the first contact element (3) and the second contact element (4) to be pushed and positioned into the internal positions (3A, 4A) thereof in the first housing (11) and the second housing (21) by the first hooking element (A1) and the second hooking element (A2), when they are moved into the neared configuration (S2) for hooking the ski boot (S).

For example, the at least a compression spring (56, 57) is preferably such as to maintain the first contact element (3) and the second contact element (4) in a slightly extracted position from the first (11) and second (21) housing, in any case so that the first hole (31) and the second hole (41) are aligned with the alignment axis (A) (situation not illustrated in the figures).

The at least a compression spring (56, 57) is further configured to push the first contact element (3) and the second contact element (4) towards the outside of the first housing (11) and the second housing (21) in order to maintain the contact with the hooking elements (A1, A2) as a consequence of a misalignment of the alignment axis (A) with the operating plane (PO) of the hooking elements (A1, A2) due to a rotation of the ski boot (S) with respect to the longitudinal axis (L) of the ski (K), and to retain the first contact element (3) and the second contact element (4) following the unhooking of the ski boot.

Figure 10A:
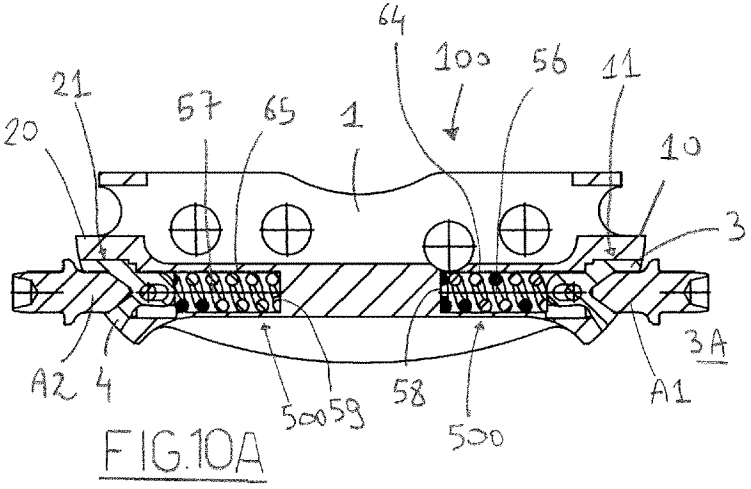
FIGS. 10A and 10B are views of the insert of the invention in a fourth possible embodiment according to a longitudinal and transversal section plane, in the two distinct configurations.
Figure 10B:
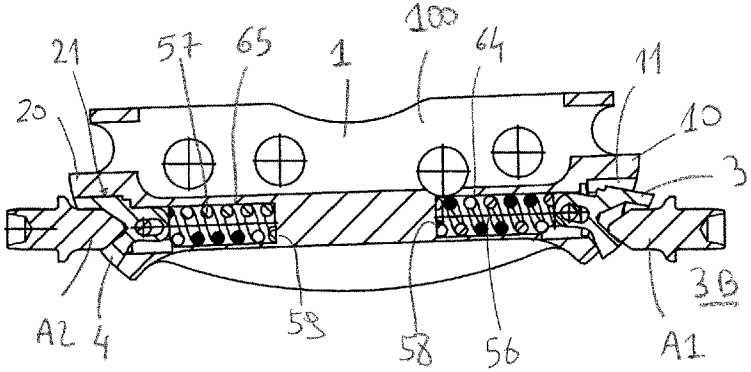

According to the preferred embodiment illustrated in FIGS. 10A and 10B, the elastic positioning means (500) are preferably constituted by two compression springs (56, 57) predisposed in relative seats (64, 65) realised in the anchoring body (1) and communicating with the first housing (11) and the second housing (21).

In this case, a first compression spring (56) is fixed by a first end thereof in abutment against a first abutment (58) of a first seat (64) and by a second end is constrained to the first contact element (3), while the second compression spring (57) is, by a first end, in abutment against a second abutment (59) of a second seat (65) and by a second end constrained to the second contact element (4).

The invention claimed is:

1. A front insert for a ski boot for ski mountaineering, for hooking the ski boot to a binding for ski mountaineering fixed to a ski and comprising a first hooking element and a second hooking element, facing one another, and movable between a splayed configuration, wherein the first hooking element and the second hooking element are in a splayed position with respect to one another to enable inserting there-between of a front part of a ski boot for ski mountaineering, and a neared configuration wherein the first hooking element and the second hooking element are in a neared position with respect to one another, in an operating plane that is transversal and perpendicular to a longitudinal axis of the ski, for hooking the ski boot, the insert being conformed so as to comprise:

an anchoring body comprising two heads and having dimensions such that the two heads, when the insert is fixed to the ski boot, are positioned at lateral portions of the front part of the ski boot;

a first housing, realised in the first head;

a second housing, realised in the second head;

a first contact element comprising a first hole which is conformed so as to have a coupling surface for coupling with the first hooking element;

a second contact element comprising a second hole which is conformed so as to have a coupling surface for coupling with the second hooking element, the first housing and the first contact element are reciprocally conformed so that the first contact element is positionable with respect to the first housing so that the first hole is accessible from outside, and aligned with an alignment axis, and is positionable in the first housing in an internal position with the first hole aligned with the alignment axis;

the second housing and the second contact element are reciprocally conformed so that the second contact element is positionable with respect to the second housing so that the second hole is accessible from outside, and aligned with the alignment axis, and is positionable in the second housing in an internal position with the second hole aligned with the alignment axis;

the first housing and the first contact element are further reciprocally conformed so as to enable the first contact element to displace with respect to the first housing from the internal position towards the outside so that the first contact element can orientate and position with respect to the first housing so that the first hole misaligns from the alignment axis;

the second housing and the second contact element are reciprocally conformed so as to enable the second contact element to displace with respect to the second housing from the internal position towards the outside so that the second contact element can orientate and position with respect to the second housing in such a way that the second hole misaligns from the alignment axis;

wherein the insert is configured so that, before the ski boot is rested on the ski, the first contact element and the second contact element are arranged with respect to the first housing and the second housing so that the first hole in the first contact element and the second hole in the second contact element are aligned along the alignment axis, so that:

when the ski boot is rested on the ski and positioned with the front part between the first hooking element and the second hooking element in the splayed configuration, the alignment axis of the first hole and of the second hole is aligned to the operating plane of the hooking elements so that the first hooking element and the second hooking element can be moved into the neared configuration for hooking the ski boot, with the first hooking element inserting in the first hole of the first contact element and with the first contact element in the relative internal position of the first housing and with the second hooking element inserting in the second hole of the second contact element and with the second contact element in the relative internal position of the second housing, and so that, following the hooking of the ski boot, at least one from between the first contact element and the second contact element, consequently to a rotation of the ski boot with respect to the longitudinal axis of the ski which determines a misalignment between the alignment axis and the operating plane of the hooking elements, can be pushed by the relative hooking element to perform a displacement from the internal position towards the outside of the first or second housing orientating and positioning itself with respect to the relative first or second housing in such a way that the relative first hole or second hole misaligns from the alignment axis, so as to remain in contact with the hooking element, thus guaranteeing the maintaining of the hooking of the ski boot.

2. The insert of claim 1, wherein the walls of the first housing and the walls of the first contact element are conformed so as to enable a form coupling of the first contact element with the first housing when the first contact element is in the internal position and so as to enable a displacement of the first contact element, from the internal position of the first housing towards the outside, which comprises a first translation movement and a second rotation movement so that the first contact element can orientate and position with respect to the first housing with the first hole misaligning from the alignment axis, and wherein the walls of the second housing and the walls of the second contact element are conformed so as to enable a form coupling of the second contact element with the second housing when the second contact element is in the internal position and so as to enable a displacement of the second contact element, from the internal position of the second housing towards the outside, which comprises a first translation movement and a second rotation movement so that the second contact element can orientate and position with respect to the second housing with the second hole misaligning from the alignment axis.

3. The insert of claim 2, wherein:

the walls of the first housing comprise a rear rest wall and a front rest wall inclined with respect to the alignment axis and which is inclined with respect to the longitudinal axis of the ski when the ski boot is rested on the ski and hooked to the binding for ski mountaineering, and wherein the walls of the first contact element comprise a rear abutting wall and a front abutting wall, with the rear abutting wall being conformed in such a way as to abut the rear rest wall of the first housing and with the front abutting wall being conformed in such a way as to abut the front rest wall of the first housing when the first contact element is in the internal position of the first housing, the walls of the second housing comprise a rear rest wall and a front rest wall inclined with respect to the alignment axis and which is inclined with respect to the longitudinal axis of the ski when the ski boot is rested on the ski and hooked to the binding for ski mountaineering, and wherein the walls of the second contact element comprise a rear abutting wall and a front abutting wall, with the rear abutting wall being conformed in such a way as to abut the rear rest wall of the second housing and with the front abutting wall being conformed in such a way as to abut the front rest wall of the second housing when the second contact element is in the internal position of the second housing.

4. The insert of claim 1, further comprising positioning means which are configured in such a way as to maintain the first contact element positioned in the internal position of the first housing and the second contact element positioned in the internal position of the second housing, the positioning means being further configured so as to enable the displacement of the first contact element from the internal position towards the outside and the displacement of the second contact element from the internal position towards the outside so that the first contact element can orientate and position with respect to the first housing with the first hole misaligned from the alignment axis and so that the second contact element can orientate and position with respect to the second housing with the second hole misaligned from the alignment axis.

5. The insert of claim 4, wherein the positioning means comprise elastic means which are predisposed in a seat realised in the anchoring body in such a way as to be constrained to the first contact element and the second contact element.

6. The insert of claim 5, wherein the elastic means comprise a traction spring positioned in a seat realised in the anchoring body and communicating with the first housing and a second housing, wherein the traction spring is constrained by a first end to the first contact element and by a second end to the second contact element.

7. The insert of claim 5, wherein the elastic means comprise two traction springs positioned in seats which are communicating with the first housing and the second housing, wherein a first traction spring of said two traction springs is fixed by a first end thereof to the anchoring body and by a second end to the first contact element, and with a second traction spring of said two traction springs being fixed by a first end thereof to the anchoring body and by a second end to the second contact element.

8. The insert of claim 7, wherein the traction springs are configured so as to retain and maintain the first contact element in the internal position of the first housing and the second contact element in the internal position of the second housing and to enable the displacement from the relative internal position towards the outside, wherein the traction springs are further configured to recall and return the first contact element and the second contact element into the internal position following the detachment and decoupling of the first contact element and the second contact element from the first hooking element and the second hooking element consequently to the unhooking of the binding for ski mountaineering from the ski boot.

9. The insert of claim 8, wherein the traction springs are configured so as to enable a displacement of the first contact element from the internal position of the first housing towards the outside up to a final external position wherein the first contact element is orientated and positioned so that the first hole has an angle of inclination that is maximum with respect to the alignment axis beyond which the detaching and decoupling of the first contact element with the first hooking element takes place and therefore the unhooking of the ski boot, and wherein the traction springs are configured so as to enable a displacement of the second contact element from the internal position at the second housing towards the outside up to a final external position in which the second contact element is orientated and positioned so that the second hole has an angle of inclination that is maximum with respect to the alignment axis beyond which the detaching and decoupling of the second contact element from the second hooking element takes place and therefore the unhooking of the ski boot.

10. The insert of claim 4, wherein the positioning means are constituted by magnetic means comprising first magnetic means having a first polarity which are predisposed in the first contact element and the second contact element and second magnetic means having a second polarity opposite to the first polarity which are predisposed in a bottom wall of the first housing and second housing.

11. The insert of claim 4, wherein the positioning means are constituted by the walls of the first housing and the walls of the first contact element which are reciprocally conformed to form a form coupling so as to maintain stationary and retain the first contact element in the first housing when the first contact element is in the internal position, and also by the walls of the second housing and the walls of the second contact element which are reciprocally conformed to form a form coupling which maintains stationary and retains the second contact element in the second housing when the second contact element is in the internal position.

12. The insert of claim 11, comprising retaining elements which are predisposed at the heads of the anchoring body and which are conformed and configured to retain the first contact element and the second contact element, once displaced externally of the first housing and second housing, following the detaching and decoupling from the hooking elements of the ski mountaineering binding following the unhooking from the ski boot.

13. The insert of claim 1, comprising elastic positioning means comprising at least a compression spring predisposed in at least a seat realised in the anchoring body and communicating with the first housing and the second housing, wherein the at least a compression spring is constrained to the first contact element and the second contact element, the at least a compression spring is configured so as to maintain, before the hooking of the ski boot, the first contact element and the second contact element positioned with respect to the first housing and the second housing so that the first hole and the second hole are aligned with the alignment axis and thus enable the first contact element and the second contact element to be pushed and positioned into the internal positions thereof in the first housing and the second housing by the first hooking element and the second hooking element, when they are moved into the neared configuration for hooking the ski boot, and to push the first contact element and the second contact element towards the outside of the first housing and the second housing in order to maintain the contact with the hooking elements as a consequence of a misalignment of the alignment axis with the operating plane of the hooking elements due to a rotation of the ski boot with respect to the longitudinal axis of the ski, and to retain the first contact element and the second contact element following the unhooking of the ski boot.

* * * * *